US006834595B1

(12) United States Patent
Henderson

(10) Patent No.: US 6,834,595 B1
(45) Date of Patent: Dec. 28, 2004

(54) POWER RAIL STEERING AND DIRECTION CONTROL APPARATUS

(76) Inventor: J. Kirston Henderson, 1709 Ridgmar Blvd., Fort Worth, TX (US) 76116-2016

( * ) Notice: Subject to any disclaimer, the term of this patent is extended or adjusted under 35 U.S.C. 154(b) by 0 days.

(21) Appl. No.: 10/368,503

(22) Filed: Feb. 18, 2003

Related U.S. Application Data

(60) Provisional application No. 60/358,045, filed on Feb. 19, 2002, and provisional application No. 60/357,883, filed on Feb. 19, 2002.

(51) Int. Cl.[7] ..... B61J 3/00
(52) U.S. Cl. ..... 104/88.01
(58) Field of Search ..... 104/88.01, 88.02, 104/96, 118, 119, 287, 288, 290

(56) References Cited

U.S. PATENT DOCUMENTS 3,575,255 A * 4/1971 Wickstrom ..... 180/168
3,730,103 A * 5/1973 Weaver ..... 105/141
3,786,762 A * 1/1974 Corkum et al. ..... 104/288
3,871,300 A * 3/1975 Perrott ..... 104/130.02
5,845,581 A * 12/1998 Svensson ..... 104/120
6,651,566 B2 * 11/2003 Stephan et al. ..... 104/288

* cited by examiner

*Primary Examiner*—S. Joseph Morano
*Assistant Examiner*—Robert J. McCarry, Jr.
(74) *Attorney, Agent, or Firm*—Bracewell & Patterson, L.L.P.

(57) ABSTRACT

A transport system has a pair of laterally spaced apart guideways, each of the guideways having an upward facing track. A vehicle has supports on each side that engage the tracks. A pair of conductor rails are mounted to a shroud extending over the track. Each of the conductor rails has an engaging surface that faces generally laterally from the other. A follower assembly mounted to the vehicle raises into engagement with the rails. The follower assembly has brushes that engage the rails in sliding contact to receive power for the vehicle. The follower assembly is also connected to the steering mechanism of the device for steering the vehicle.

46 Claims, 7 Drawing Sheets

POWER RAIL STEERING AND DIRECTION CONTROL APPARATUS

CROSS REFERENCE TO RELATED APPLICATION

This application claims the benefit of provisional application 60/358,045 and 60/357,883, both filed Feb. 19, 2002.

FIELD OF INVENTION

This invention relates in general to transport systems for transporting vehicles along guideways, an in particular to controlling steering and directional stabilization of the vehicles.

BACKGROUND OF THE INVENTION

Transport systems have been proposed in the past that deal with individually transporting vehicles along guideways under automatic control. Some of the systems employ vehicles with rubber tires while others employ magnetic fields to levitate lateral supports of the vehicles at slight gaps above the tracks. Vehicles that engage the track with an air cushion have also been proposed for short, indoor transit systems. The prior art systems may include a steering and directional control system to maintain the vehicle directionally stable on the track guideway and provide steering.

Electrical brushes have been used in the past for slidingly contacting a conductor rail to transfer electrical power to the vehicle. For steering and directional control, some employ a guide roller that engages a steering rail mounted to the guideway. There are various disadvantages to the prior art systems.

SUMMARY OF THE INVENTION

In this invention, steering is provided by a pair of rail surfaces mounted along at least one of the guideways. The rail surfaces are located above a track for the lateral support of the vehicle. One of the rail surfaces faces laterally outward while the other faces laterally inward. A steering follower assembly is mounted to the vehicle for vertical movement between retracted and engaged positions. The follower assembly has a pair of follower members, each having a flat face that cooperatively engages one of the rail surfaces while in the extended position. The follower assembly is connected to a steering mechanism that steers the vehicle in accordance with lateral movement of the follower assembly as it moves along the rail surfaces.

In some of the embodiments, conductor rails are employed for both transferring electrical power and for providing directional control. Preferably at least one conductor rail is mounted to one of the guideways. The conductor rail is supplied with electrical power from a power supply. The steering follower assembly receives electrical power from the conductor rail for supplying power to the vehicle. The steering follower has a conductive brush slidingly engaging the conductor rail to supply power to the power unit of the vehicle. The steering follower also provides directional control. A steering linkage is cooperatively engaged with the conductive brush for steering the vehicle in response to lateral movement of the brush as it engages the conductor rail.

In one embodiment, a sensor is mounted to the brush for sensing lateral forces between the brush and conductor rail and providing signals to a steering actuator. The steering actuator controls the vehicle accordingly. Another embodiment utilizes an air chamber for the steering control and an electrical brush that transfers power from the rail. The air chamber has a face with a plurality of holes through which pressurized air is discharged to provide a slight gap between the rail and the air chamber.

DETAILED DESCRIPTION OF INVENTION

Figure 1:
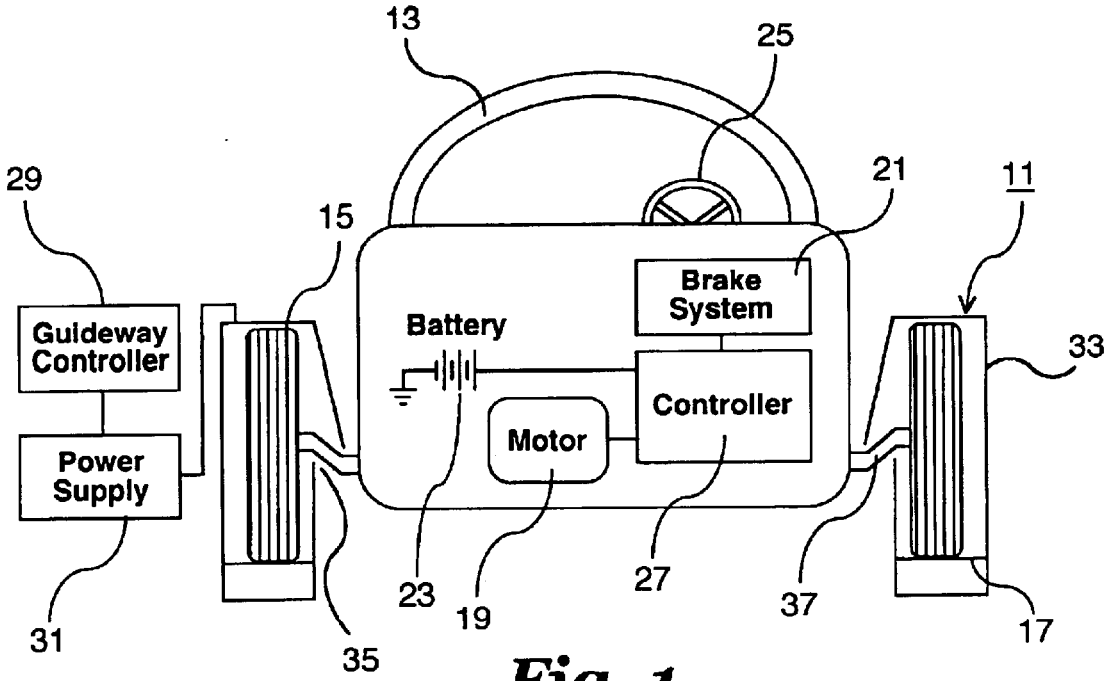
FIG. 1 is a schematic sectional view of a transport system constructed in accordance with this invention.

Referring to FIG. 1, the transport system has a pair of spaced-apart guideways 11. Guideways 11 will typically be mounted on columns and elevated above the ground. The transport system includes a vehicle 13 that configured for engaging guideways 11. Vehicle 13 could be a special purpose vehicle that is operated only on guideways 11, or it could be dual purpose vehicle that can be operated on conventional roads as well.

In this embodiment, vehicle 13 has four rubber tire wheels 15 (only two shown) that roll on tracks 17 mounted in each guideway 11. If vehicle 13 is a dual purpose type, wheels 15 are preferably retractable in width for conventional road use. Vehicle 13 has an electrical motor 19 and a brake system 21. Vehicle 13 has a battery 23 and a steering mechanism that includes in this embodiment a manually operable steering wheel 25. Steering wheel 25 would not be needed if vehicle 13 is used only on guideways 11, but an automatically controlled steering system would still be required. Vehicle 13 also has a controller 27 that controls brake system 21, motor 19 and the steering system in this embodiment.

A guideway controller 29 and a power supply 31 are stationarily mounted alongside guideway 11 for providing power to guideway 11. Guideway controller 29 communicates with vehicle controller 27 for controlling vehicle 13. Preferably, these signals are made by radio frequency.

Each of the guideways 11 has a shroud 33 for preventing exposure of track 17 to snow, ice and rain. Shroud 33 encloses each wheel 15 and has a longitudinal slot 35 in its inside surface. Vehicle 11 has a plurality of lateral supports or axles 37, each with an offset lower portion that passes through slot 35.

Figure 2:
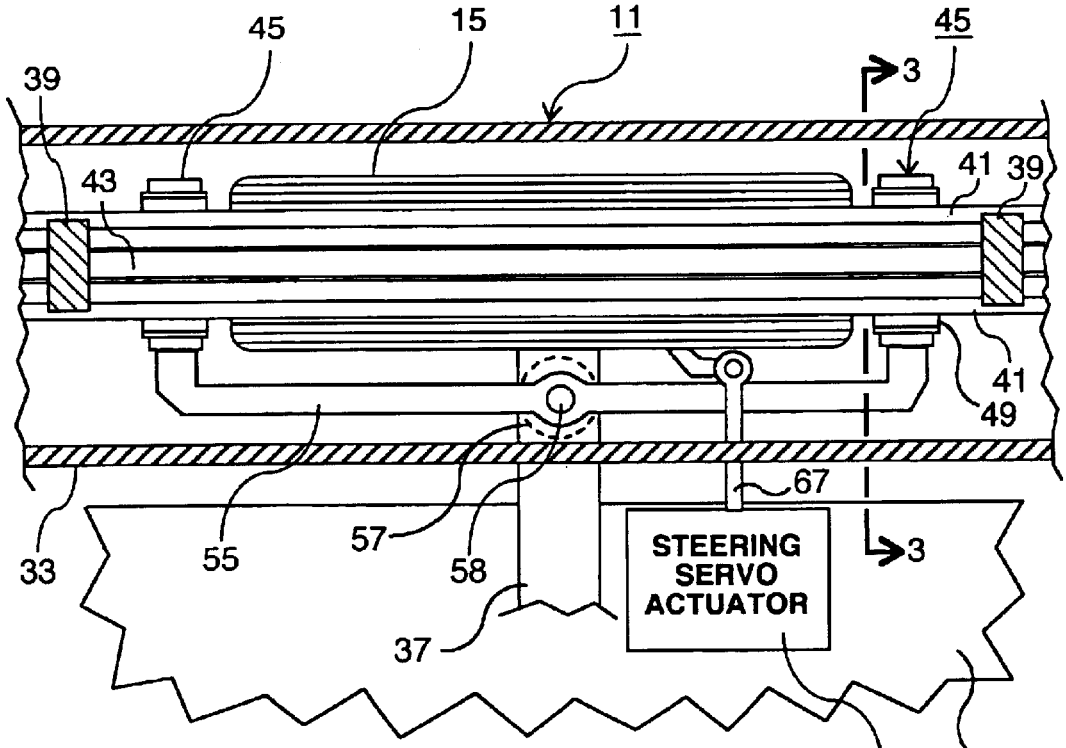
FIG. 2 is a partially schematic sectional view along the line 2—2 of FIG. 3 of one of the guideways of the transport system of FIG. 1.
Figure 3:
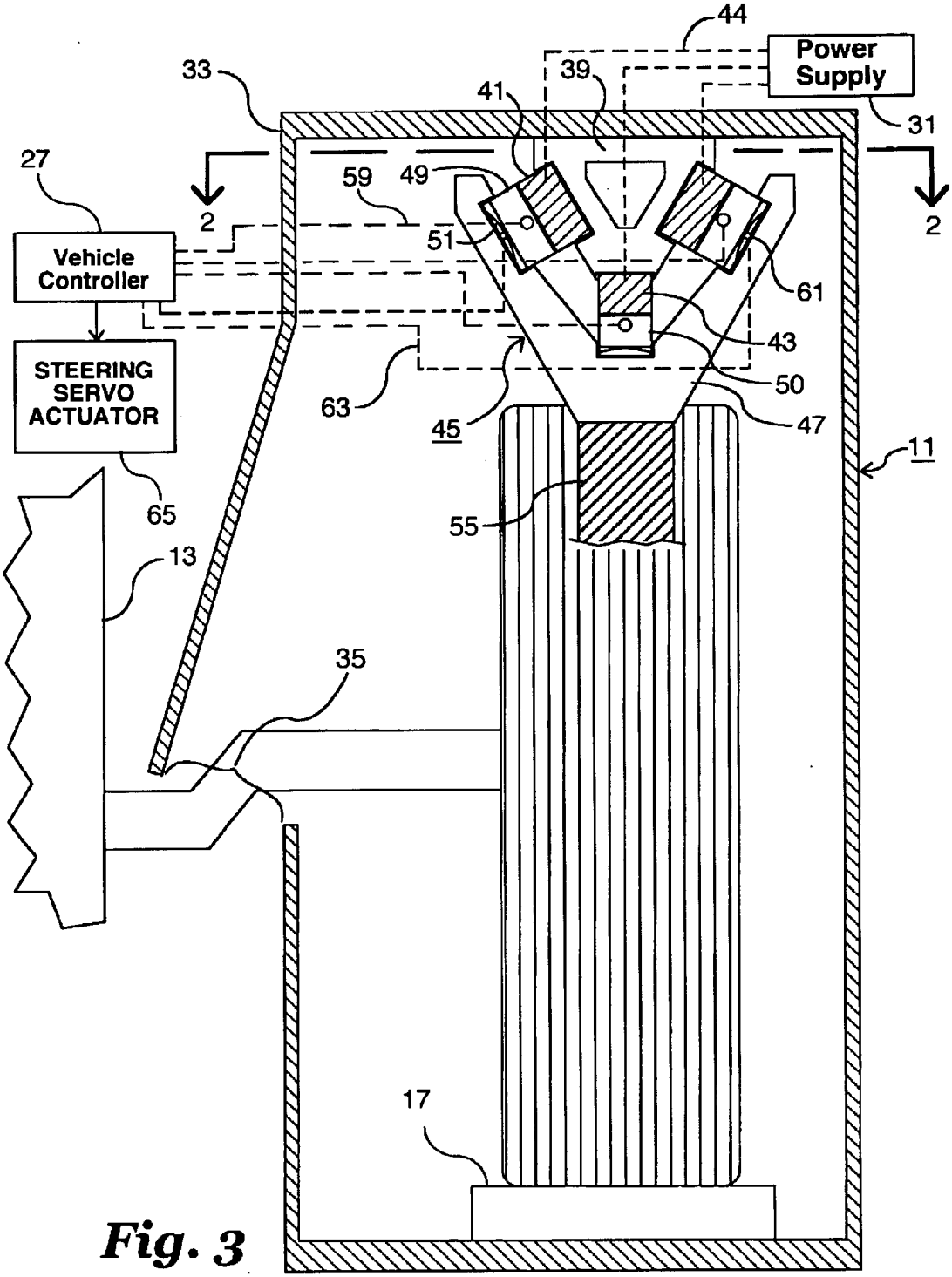
FIG. 3 is a partially schematic sectional view of the transport system of FIG. 1, taken along the line 3—3 of FIG. 1.

Referring to FIGS. 2 and 3, a plurality of insulators 39 are secured to the inner surface of the upper side of shroud 33. Insulators 39 are longitudinally spaced apart from each other as illustrated in FIG. 2. Insulators 39 support a pair of longitudinally extending upper rails 41. In this embodiment, each upper rail 41 has an engaging surface that faces generally downward and laterally away from each other. The engaging face of the upper rail 41 located on the outer side of shroud 33 faces downward and outward and is inclined at an angle of about 60° relative to horizontal. Similarly, the engaging face of inner upper rail 41 faces downward and inward and is inclined at an angle of about 60° relative to horizontal. The angles could vary. Additionally, a lower rail 43 is located below and between upper rails 41. Lower rail 43 is also a conductive rail and has an engaging surface that faces straight downward. Rails 41 and 43 are connected to power supply 31 with wires 44 for receiving electrical power.

A follower assembly 45 is carried by vehicle 13 for engaging rails 41 and 43. In this embodiment, follower assembly 45 includes a yoke 47 that is generally Y-shaped, having two upward diverging arms and a vertical downward extending leg. A pair of upper brushes 49 are mounted to inside surfaces of the arms. Upper brushes 49 have flat faces that face generally toward each other for mating with the engaging surfaces of upper rails 41. The inward upper brush 49 thus faces outward and upward and is inclined at an angle of about 60° relative to horizontal. Similarly, the outward upper brush 49 faces generally upward and inward and is inclined at an angle of about 60° relative to horizontal. A lower brush 50 faces straight upward in alignment with lower rail 43. Brushes 49 and 50 slidingly engage rails 41 and 43, respectively.

Preferably, each brush 49, 50 is movable relative to yoke 47 and biased by springs 51. Springs 51 bias brushes 49, 50 into sliding contact with rails 41, 43, respectively. Yoke 47 is mounted to a support member 55. As shown in FIG. 2, support member 55 extends longitudinally and has a center mounted to axle 37 at a pivot point 58. Preferably, one of the follower assemblies 45 is mounted in front of each front wheel 15 and one behind each front wheel 15. Support member 55 pivots on pivot point 58 as wheel 15 turns so that support member 55 always remains parallel with a vertical plane containing wheel 15.

Figure 5:
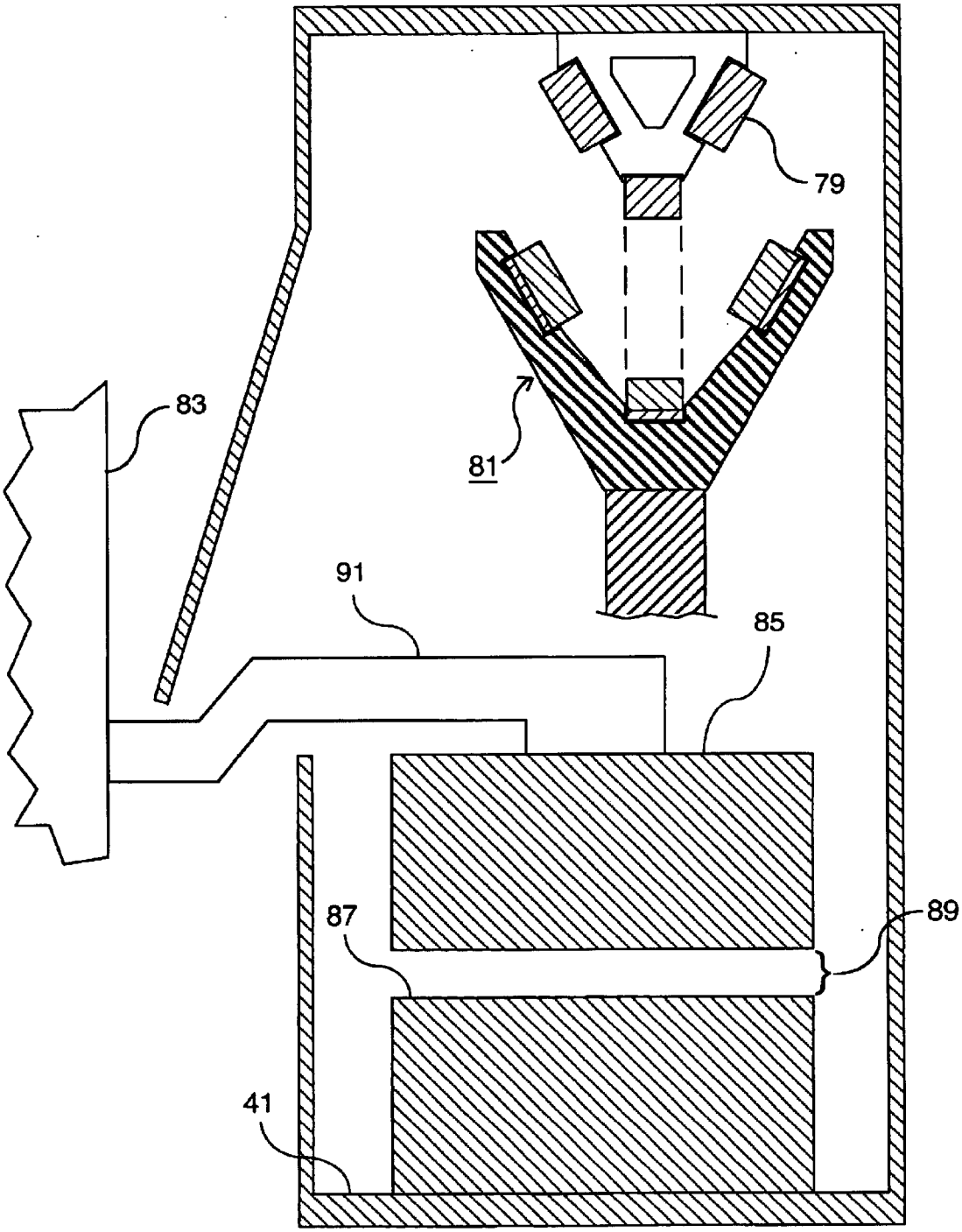
FIG. 5 is a sectional view similar to FIG. 3, but showing the follower assembly retracted and also showing an alternate embodiment of the guideway.

Also, a lifting mechanism 57 is mounted between axle 37 and support member 55. Lifting mechanism 57 is schematically shown and is preferably an electrically powered actuator that moves support member 55 and follower assemblies 45 upward from a retracted position into engagement with rails 41, 43 as shown in FIG. 3. The alternate embodiment of FIG. 5 illustrates the retracted position.

Referring back to FIG. 3, wires 59 extend from brushes 49, 50 to vehicle controller 27 for supplying power. In this embodiment, sensors 61 are mounted to the engaging faces of brushes 49. Pressure sensors 61 sense lateral forces between upper brushes 49 and upper rails 41. Signals corresponding to these forces are transmitted via wires 63 to vehicle controller 27. Vehicle controller 27 has a microprocessor or circuitry that detects the signals and provides steering signals to a servo actuator 65, also shown in FIG. 2. Servo actuator 65 is connected by a steering linkage 67 to each front wheel 15 for turning front wheels 15, if needed, in response to the forces being monitored by sensors 61.

Preferably, each of the front wheels 15 has a pair of follower assemblies 45 as described. However, the follower assemblies 45 at only one wheel 15 need be used for steering and supplying power at any particular time. Typically, lifting device 57 on one side of vehicle 13 will be in a retracted position while on the other side in the engaged position. When approaching intersecting guideways, it may be necessary for the operator to switch engagement from follower assemblies 45 on one side of vehicle 13 to that of the other. This could be handled automatically based on signals provided by guideway controller 29.

In operation, follower assemblies 45 on one side of vehicle 13 will be in the engaged position shown in FIG. 3. Upper brushes 49 will be in sliding engagement with upper rails 41 while lower brush 50 will be in sliding engagement with lower rail 43. Three-phase power is supplied from power supply 31 via wires 44 to each of the rails 41, 43. Brushes 49, 50 transfer electrical power from rails 41, 43 to vehicle controller 27 through wires 59.

At the same time, upper brushes 49 provide steering control and directional stability. If the vehicle begins departing from the direction of rails 41, this will cause a lateral force to increase between one of the brushes 49 and one of the rails 41. The force between the other brush 49 and other rail 41 will decrease. Pressure sensors 61 detect the change and provide that information to vehicle controller 27, which causes server actuator 65 to move steering linkage 67 to make the correction.

Figure 4:
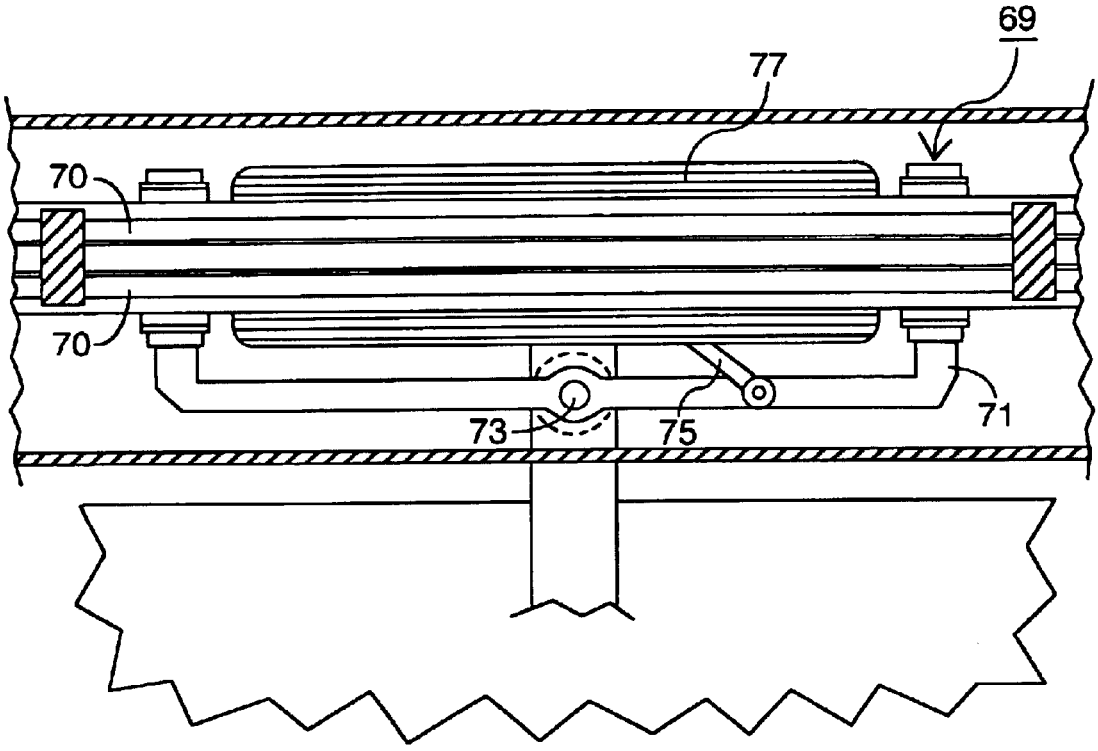
FIG. 4 is a sectional view similar to FIG. 2 but showing an alternate embodiment of the guideway.

The embodiment illustrated in FIG. 4 is the same as the first embodiment, except that it does not utilize lateral force sensors, such as sensors 61 of FIG. 3. Follower assembly 69 is the same as follower assembly 45 in FIG. 3 in that it receives power and provides steering control. When follower assembly 69 begins to diverge from the direction of upper rails 70, it will cause a lateral movement in its support member 71. Support member 71 will pivot at pivot point 73, causing a movement to steering linkage 75. Steering linkage 75 makes a slight correction to wheel 77 as mechanical force is being applied through follower assembly 69.

Figure 8:
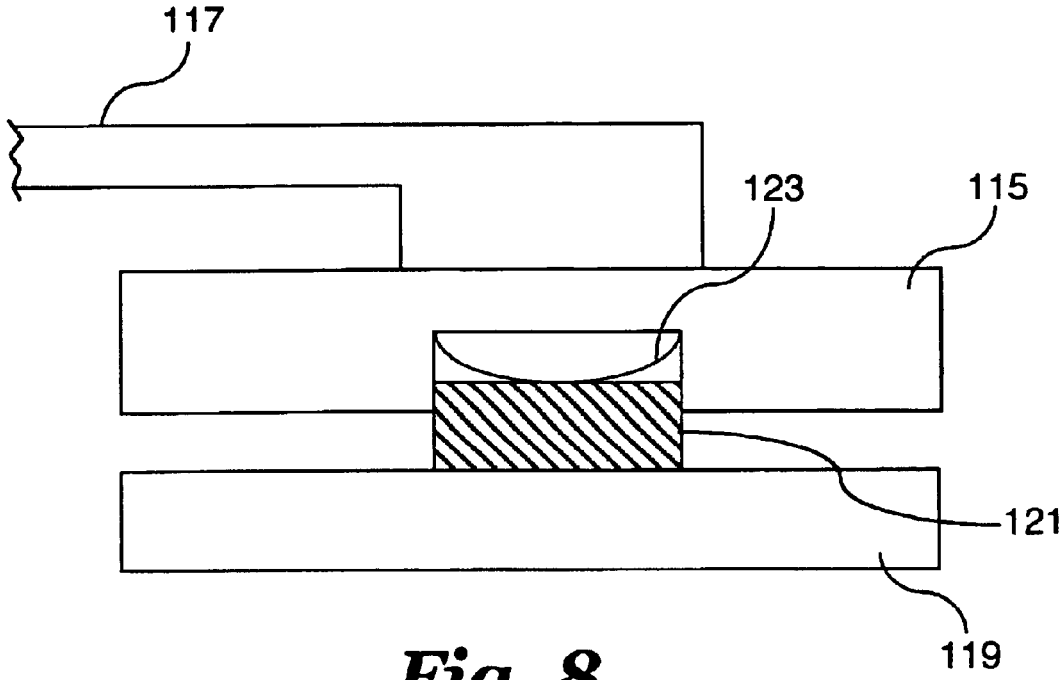
FIG. 8 is a schematic sectional view of another embodiment of the lateral support of the vehicle, showing a conductive brush mounted to an air cushion levitation member.

The embodiment of FIG. 5 is the same as either of the first two embodiments, except the vehicle does not use wheels for lateral support. The required steering forces are lower, thus the mechanical steering system of FIG. 4 readily can handle steering control. As shown in FIG. 5, rails 79 are suspended in the same manner as the first embodiment. Follower 81 may be constructed as in FIG. 4. Vehicle 83 is of a type having levitation members 85 on its sides for supporting the vehicle above levitation tracks 87. Each levitation members 85 may be electromagnetic and supported above track 87 by a gap 89. An example of electromagnetic levitation is shown in U.S. Pat. No. 6,357,358. Normally levitation members 85 would have permanent magnets and electrical coils would be imbedded in track 87. Alternately, levitation members 85 may be of a type that utilizes air pressure for levitating above track 87, as illustrated in the embodiment of FIG. 8. Each levitation member 85 is connected to a lateral support 91 in a manner similar to axle 37 in the first embodiment. At least some of the power may be supplied through follower assembly 81 in the same manner as in connection with the first two embodiments.

Figure 6:
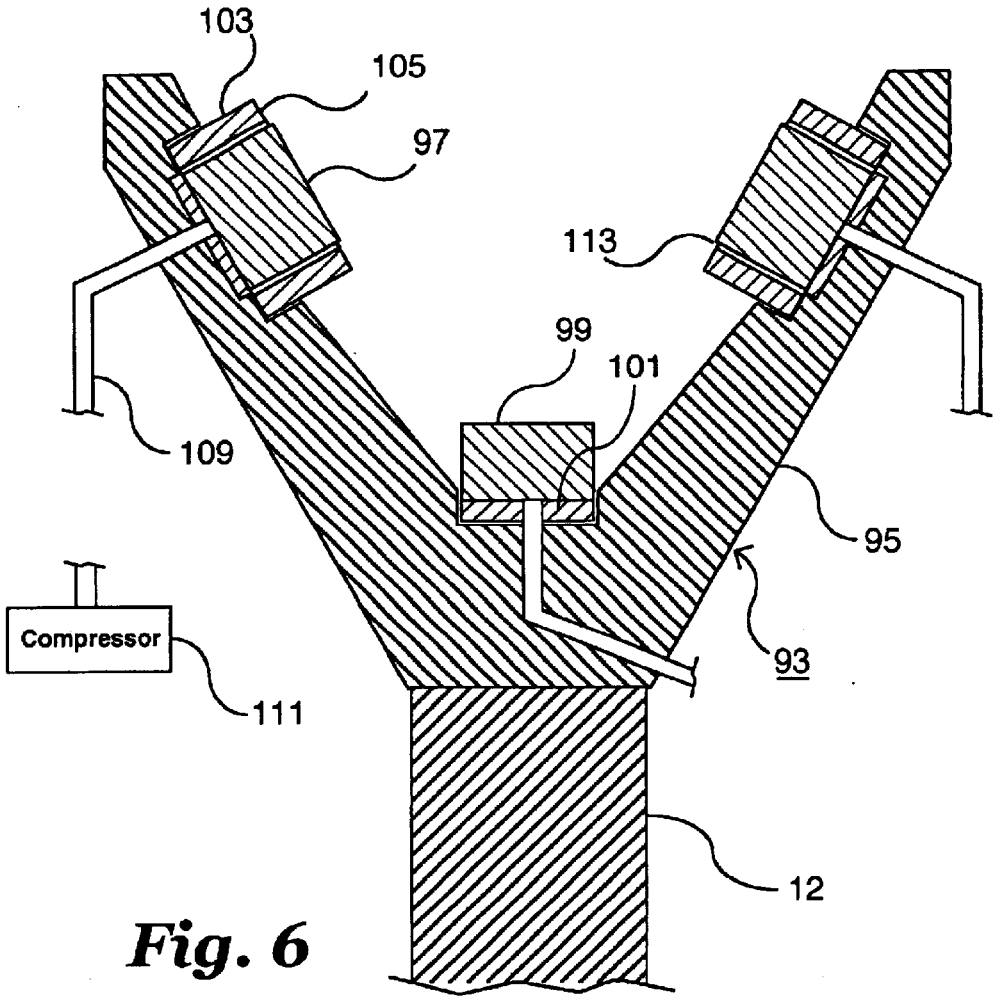
FIG. 6 is a partially schematic sectional view of another alternate embodiment of the follower assembly.

In the embodiment of FIG. 6, the vehicle could either be of a type utilizing wheels, as in the first embodiment, or levitation supports as in the third embodiment. The difference in this embodiment is that the upper rails (not shown) are not engaged in sliding contact for steering control. In this embodiment, follower 93 has a yoke 95 as in the other embodiments. Upper brushes 97 are mounted to the arms, and a lower brush 99 is mounted at the junction between the arms. Upper brushes 97 and lower brush 99 are preferably biased outward by springs 101 for sliding contact with rails (not shown), such as rails 41 and 43 of FIG. 3.

Figure 7:
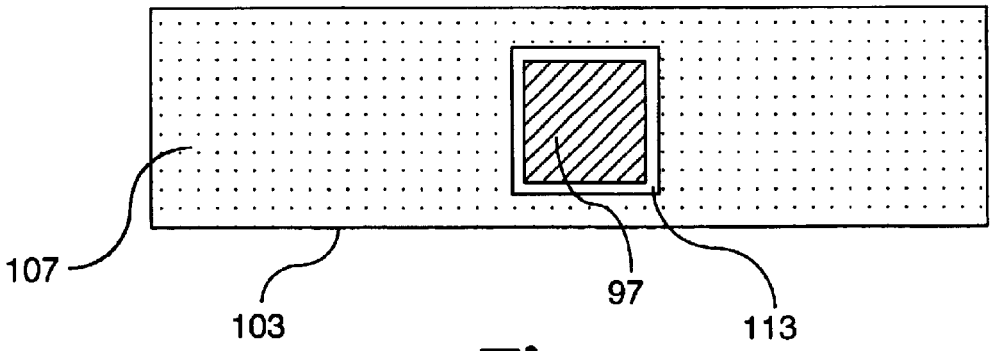
FIG. 7 is a side elevational view of the face of one of the air cushion chambers mounted to the steering follower of FIG. 6.

Steering control, however, is provided by air cushion chambers 103. Each chamber 103 is mounted to an arm of yoke 95 at an inclined angle for cooperative engagement with upper rails 41 of FIG. 3. Air cushion chamber 103 has a face 105 with at least one hole 107, and preferably a plurality of holes 107, as illustrated in FIG. 7. A conduit 109 leads from air cushion chamber 103 to a compressor 111 mounted on the vehicle. Air compressor 111 supplies compressed air to each chamber 103 for discharge out holes 107. As shown in FIG. 7, preferably each air chamber 103 has an aperture 113 within it that surrounds one of the upper brushes 97. Spring 101 biases brush 97, but does not bias cushion chamber 103.

In the operation of the embodiment of FIGS. 6 and 7, follower 93 is raised into engagement with the rails, such as rails 41 and 43 of FIG. 3. Brushes 97 slidingly engage upper rails 41, while a slight gap will exist between each air cushion face 105 and each upper rail. The air pressure discharged from holes 107 creates forces against the opposite facing rails 41. The forces push outward on air cushion chambers 103 equally, causing equal gaps to occur between faces 105 and rails 41. These forces create a bias tending to maintain the gaps between each cushion face 105 and each rail 41 equal. As the vehicle begins to diverge from the direction of the rails 41, one of the gaps narrows and the other widens. An increasing lateral force occurs in the gap that narrows that is greater than the lateral force where the gap has widened. This unbalance causes a steering correction to be made through steering linkage of the vehicle. Air chambers 103 thus are in cooperative engagement with rails 41 (FIG. 3), although spaced from them by a slight gap.

Also, air chambers 105, when used with a magnetic levitation lateral support, tends to stabilize the vehicle against vertical movement. Vehicles that are levitated by permanent magnets tend to move upward and downward as they move along the guideways. The interaction of the air chambers 105 with the inclined upper rails provides stabilizing forces against this vertical movement.

The embodiment of FIG. 8 discloses an air cushion chamber 115 that has at least one, and preferably a plurality of holes, on its lower side and is mounted to a lateral support 117 of a vehicle. Pressurized air is delivered to chamber 115 to cause the vehicle to levitate, with a slight gap existing between each chamber 115 and each track 119. In this embodiment, electrical power is supplied to track 119. An electrical brush 121 is mounted to chamber 115 and protrudes downward. A spring 123 biases brush 121 against track 119 for receiving power from track 119. Preferably brush 121 is located within a central aperture in the face of chamber 115 in the same manner as in the embodiment of FIG. 7. In operation, the vehicle is levitated by chambers 115 while brush 121 communicates electrical power.

Figure 9:
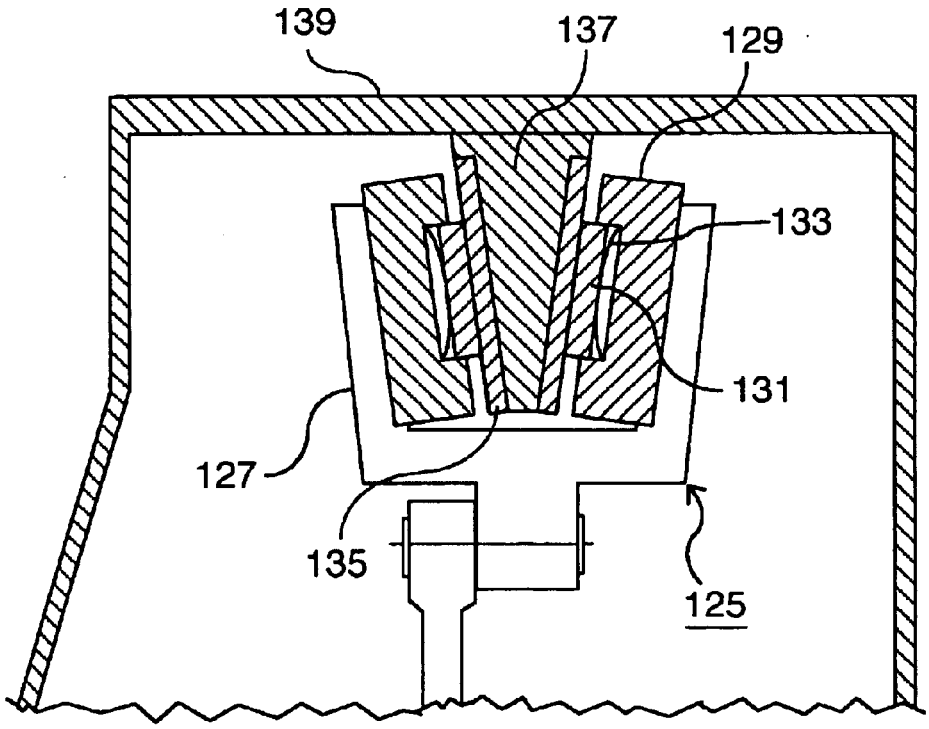
FIG. 9 is a schematic sectional view of another embodiment of the follower assembly.

In the embodiment of FIG. 9, follower 125 differs in that it transmits power through only two conductors, rather than three as in the embodiments of FIGS. 2, 5 and 6. Follower 125 has a pair of upward extending arms 127, each of which supports an air cushion chamber 129. Each chamber 129 has holes on its engaging face and is supplied with pressurized air. Each chamber 129 has a central aperture that receives an electrical brush 131. Brush 131 is biased away from chamber 129 by a spring 133 against a conductive rail 135.

Rails 135 are mounted to insulators 137 that are secured to the interior of the upper side of a shroud 139. Rails 135 are shown inclined from vertical a lesser amount than in the other embodiments, but this angle is variable. Rails 135 are supplied with electrical power, particularly two phases of a three-phase power supply. The third phase may be supplied through another brush, such as brush 121 in levitating member 115 (FIG. 8). Steering control is provided through chamber 129 while electrical power is conducted through rails 135.

Figure 10:
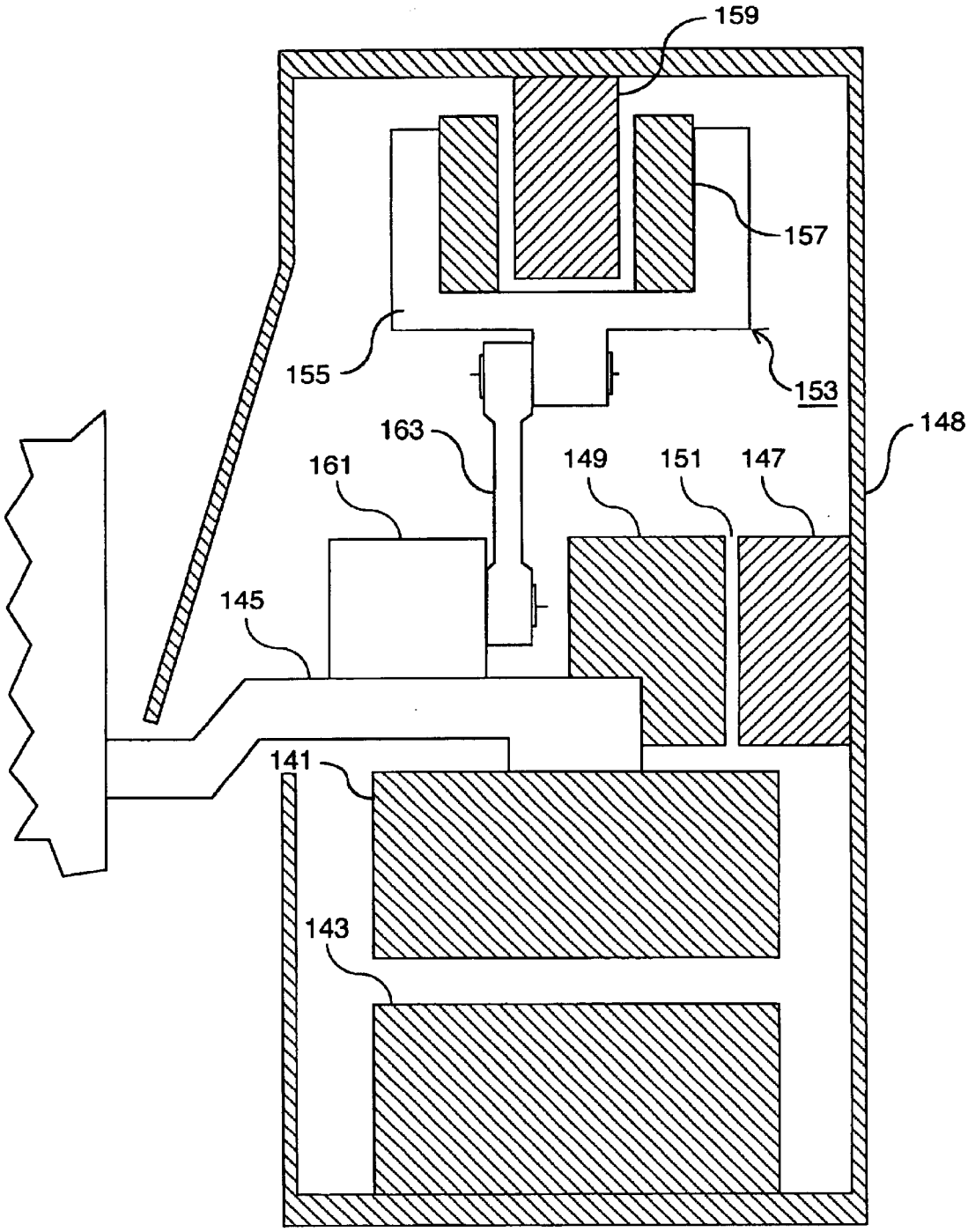
FIG. 10 is a schematic sectional view of another embodiment of the system.

The vehicle of the embodiment of FIG. 10 has levitation members 141 that may either be electromagnetic or air cushion types. Levitation members 141 are secured to lateral supports 145 and spaced above track 143 by a slight gap due to magnetic fields or air cushions. A linear motor made up of a stationary component 147, which is mounted to a sidewall of shroud 148, and a movable component 149, supplies thrust to move the vehicle along the tracks 143. Movable component 149 is mounted to the vehicle and separated from stationary component 147 by a slight gap 151. Movable component 149 preferably comprises windings of coils that are supplied with power. Stationary component 147 is magnetic, similar to a stator of an electrical motor. Stationary component 147 could be a reaction rail made of copper or aluminum. This arrangement could be reversed, however, with the stationary component 147 having windings and with power being supplied to the windings.

In this embodiment, follower assembly 153 supplies only steering control and does not transmit electrical power to the vehicle. Electrical power is supplied through other rails and brushes that are not shown. Follower assembly 153 has a pair of upward extending arms 155 that have follower members 157 mounted to their inner sides that could be either air cushions or magnetic devices. A pair of rail surfaces 159 are suspended from shroud 148 and face in opposite lateral directions. Follower members 157 have flat engaging faces that are spaced from rail surfaces 159 by gaps that are biased to be equal due to repelling magnetic fields or air cushions. The engaging faces of follower members 157 and rail surfaces 159 are in vertical planes in this embodiment.

An actuator 161 has a movable arm 163 mounted to follower assembly 153. Actuator 161 will selectively raise and lower follower assembly 153. Steering control is provided by lateral movement of follower assembly 153 as the follower members 157 move along rail surfaces 159. When the gaps between follower members 157 and rail surfaces 159 are equal, the lateral forces exerted due to repelling magnetic fields or air pressure are the same. If one of the gaps narrows and the other widens, the forces become unequal, causing a steering linkage (not shown) connected with follower assembly 153 to make a steering correction.

The invention has significant advantages. In some embodiment, the upper rails provide dual functions of steering control as well as providing power. Power is effectively provided through brushes in a follower assembly that can be readily retracted. The steering can be performed automatically, either through mechanical force or by sensors that provide signals to servo actuators. The embodiment utilizing air pressure reduces friction between the follower assembly and the rails. The interaction of the air chambers with the inclined rails provides a downward force that stabilizes magnetically levitated vehicles. The "V" shaped configuration of the upper rails in most of the embodiments facilitates engagement of the follower assembly as it moves upward from the retracted position.

While the invention has been shown in only a few of its forms, it should be apparent to those skilled in the art that it is not so limited but susceptible to various changes without departing from the scope of the invention.

I claim:

1. A transport system, comprising:

a pair of laterally spaced-apart guideways, each having an upward facing track surface and a longitudinal axis;

a pair of rail surfaces mounted to one of the guideways above the track surface, one of the rail surfaces facing laterally outward and the other facing laterally inward relative to the longitudinal axis, the rail surfaces extending longitudinally along the guideway;

a vehicle having a plurality of lateral supports that cooperate with the track surfaces of the guideways to convey the vehicle along the guideways;

a follower assembly mounted to the vehicle, having a pair of follower members, one having a flat face that faces laterally outward and the other having a flat face that faces laterally inward for juxtaposition with the rail surfaces;

a steering mechanism cooperatively engaged with the follower assembly for steering the vehicle in response to lateral movement of the follower assembly as the vehicle moves along the guideways; and a lifting mechanism mounted to the vehicle for selectively raising the follower assembly relative to the vehicle into cooperative engagement with the rail surfaces and lowering the follower assembly out of cooperative engagement with the rail surfaces.

2. The transport system according to claim 1, wherein the follower assembly comprises a pair of upward extending arms, each of the follower members being mounted to one of the arms.

3. The transport system according to claim 1, wherein each of the guideways further comprises a shroud that extends over the track surface, and wherein the rail surfaces are suspended from an upper side of the shroud above the track surface.

4. The transport system according to claim 1, wherein the faces of the follower members engage the rail surfaces in sliding contact.

5. The transport system according to claim 1, wherein each of the faces of the follower members is spaced and biased away from one of the rail surfaces by a gap.

6. The transport system according to claim 1, wherein each of the faces of the follower members is biased away from one of the rail surfaces by a magnetic field.

7. The transport system according to claim 1, wherein each of the faces of the follower members has at least one hole, and wherein the vehicle further comprises an air pressure source for discharging air through the holes to bias the faces of the follower members away from the rails surfaces by gaps.

8. The transport system according to claim 1, wherein the lateral supports comprise wheels that roll on the track surfaces.

9. The transport system according to claim 1, wherein the lateral supports comprise magnetic levitation members that levitate above the track surfaces by a gap due to magnetic fields.

10. The transport system according to claim 1, wherein the lateral supports comprises air chambers having at least one aperture, and the vehicle further comprises an air source for supplying pressurized air to the air chambers to discharge from the apertures and levitate the air chambers above the track surfaces by gaps.

11. The transport system according to claim 1, wherein the rail surfaces also incline downward relative to horizontal.

12. A transport system, comprising:

a pair of laterally spaced guideways;

a vehicle having a plurality of lateral supports that engage the guideways and a power unit with a vehicle controller for causing the vehicle to traverse along the guideways;

at least one conductor rail mounted to one of the guideways;

a power supply connected to the conductor rail for providing power to the power unit of the vehicle; and a follower assembly mounted to the vehicle and in cooperative engagement with the conductor rail for steering the vehicle in response thereto, the follower assembly also receiving electrical power from the conductor rail and being electrically connected to the vehicle controller for supplying power to the power unit.

13. The system according to claim 12, wherein the follower assembly comprises:

a conductive brush electrically connected to the vehicle controller and slidingly engaging the conductor rail to supply power to the power unit.

14. The system according to claim 12, wherein the follower assembly comprises:

a conductive brush electrically connected to the vehicle controller and slidingly engaging the conductor rail to supply power to the power unit; and wherein the vehicle further comprises:

a steering linkage confusing a Y-shaped yoke connected to the conductive brush for steering the vehicle in response to lateral movement of the brush as it engages the conductor rail.

15. The system according to claim 12, further comprising:

a retracting device carried by the vehicle for selectively retracting the follower assembly from engagement with the conductor rail, and wherein the retracting device moves the follower assembly substantially vertically.

16. The system according to claim 12, wherein the lateral supports of the vehicle comprise rubber tires, each of the tires engaging a track mounted to each of the guideways.

17. A transport system, comprising:

a pair of laterally spaced guideways;

a vehicle having a plurality of lateral supports that engage the guideways and a power unit with a vehicle controller for causing the vehicle to traverse along the guideways;

at least conductor rail mounted to one of the guideways;

a power supply connected to the conductor rail for providing power to the powder unit of the vehicle;

a follower assembly mounted to the vehicle and in cooperative engagement with the conductor rail for steering the vehicle in response thereto the follower assembly also receiving electrical power from the conductor rail a nd being electrically connected to the vehicle controller for supplying power to the power unit;

wherein the follower assembly comprises:

a conductive brush electrically connected to the vehicle controller and slidingly engaging the conductor rail to supply power to the power unit;

a sensor mounted to the brush that senses lateral forces between the brush and the conductor rail; and a steering actuator mounted to the vehicle that receives signals from the sensor and steers the vehicle accordingly.

18. A transport system, comprising:

a pair of laterally spaced guideways;

a vehicle having plurality of lateral supports that engage the guideways and a power unit with a vehicle controller for causing the vehicle to traverse along the guideways;

at least one conductor rail mounted to one of the guideways;

a power supply connected to the conductor rail for providing power to the power unit of the vehicle;

a follower assembly mounted to the vehicle and in cooperative engagement with the conductor rail for steering the vehicle in response thereto, the follower assembly also receiving electrical power from the conductor rail and being electrically connected to the vehicle controller for supplying power to the power unit;

wherein the follower assembly comprises:

a conductive brush electrically connected to the vehicle controller and slidingly engaging the conductor rail to supply power to the power unit;

an air chamber having at least one hole; and an air compressor carried by the vehicle for supplying pressurized air to the air chamber, the air chamber being spaced from the conductor rail by a gap and discharging the pressurized air against the conductor rail.

19. A transport system, comprising:

a pair of laterally spaced guideways;

a vehicle having a plurality of lateral supports that engage the guideways and a power unit with a vehicle controller for causing the vehicle to traverse along the guideways;

at least one conductor rail mounted to one of the guideways;

a power supply connected to the conductor rail for providing to the power unit of the vehicle;

a follower assembly mounted to the vehicle and in cooperative engagement with the conductor rail for steering the vehicle in response thereto, the follower assembly also receiving electrical power from the conductor rail and being electrically connected to the vehicle controller for supplying power to the power unit;

wherein the lateral supports of the vehicle comprise levitation members that support the vehicle above a track mounted to each of the guideways; and a linear motor having a stationary rail member mounted to at least one of the guideways and a movable member mounted to the vehicle in close proximity to the stationary rail member, the stationary rail member being supplied with electrical power to create an electromagnetic field to cause the vehicle to move along the guideways.

20. A transport system, comprising:

a pair of laterally spaced guideways, each of the guideways having an upward facing track;

a vehicle having lateral supports extending from opposite sides of the vehicle for cooperative engagement with the tracks, the vehicle having a power unit with a vehicle controller for causing the vehicle to traverse along the guideways;

a pair of conductor rails mounted to at least one of the guideways above the track, each of the conductor rails being next to each other above the track and having an engaging surface that faces generally laterally away from the engaging surface of the other conductor rail;

a power supply connected to the conductor rails; and a follower assembly mounted to the vehicle in engagement with the conductor rails for steering the vehicle in response to the position of the conductor rails, the follower assembly having a pair of brushes that slidingly engage the engaging surfaces of the rails for receiving electrical power therefrom, the brushes being electrically connected to the vehicle controller for supplying power to the power unit.

21. The transport system according to claim 20, further comprising a steering linkage on the vehicle comprising a Y-shaped yoke connected to the follower assembly such that lateral movements of the brushes mechanically move the steering linkage.

22. The transport system according to claim 20, further comprising biasing members between each of the brushes and the follower for biasing the brushes into sliding contact with the conductor rails.

23. A transport system comprising:

a pair of laterally spaced guideways, each of the guideways having an upward facing track;

a vehicle haying lateral supports extending form opposite sides of the vehicle for cooperative engagement with the tracks, the vehicle having a power unit with a vehicle controller for causing the vehicle to traverse along the guideways;

a pair of conductor rails mounted to at least one of the guideways above the track, each of the conductor rails having an engaging surface that faces generally laterally away from the engaging surface of the other conductor rail;

a power supply connected to the conductor rails;

a follower assembly mounted to the vehicle in engagement with the conductor rails for steering the vehicle in response to the position of the conductor rails the follower assembly having a pair of brushes that slidingly engage the engaging surfaces of the rails for receiving electrical power therefrom, the brushes being electrically connected to the vehicle controller for supplying power to the power unit;

a sensor mounted to the follower assembly that senses and provides signals responsive to lateral forces imposed on the brushes due to contact with the conductor rails; and a steering actuator that receives the signals and steers the vehicle accordingly.

24. A transport system, comprising:

a pair of laterally spaced guideways, each of the guideways having an upward facing track;

a vehicle having lateral supports extending from opposite sides of the vehicle for cooperative engagement with the tracks, the vehicle having a power unit with a vehicle controller for causing the vehicle to traverse along the guideways;

a pair of conductor rails mounted to at least one of the, guideways above the track, each of the conductor rails having an engaging surface that faces generally laterally from the engaging surface of the other conductor rail;

a power supply connected to the conductor rails;

a follower assembly mounted to the vehicle in engagement with the conductor rails for steering the vehicle in response to the position of the conductor rails, the follower assembly having a pair of brushes that slidingly engage the engaging surfaces of the rails for receiving electrical power therefrom, the brushes being electrically connected to the vehicle controller for supplying power to the power unit;

a pair of air chambers mounted to the follower assembly, each of the chambers having a face that faces away from the face of the other chamber and has at least one hole; and an air compressor carried by the vehicle for supplying pressurized air to the chambers, each of the chambers being spaced from one of the engaging surfaces of the rails by air being discharged out the hole, creating a gap.

25. A transport system, comprising:

a pair of laterally spaced guideways, each of the guideways having an upward facing track;

a vehicle having lateral supports extending farm opposite sides of the vehicle for cooperative engagement with the tracks, the vehicle having a power unit with a vehicle controller for causing the vehicle to traverse along the guideways;

a pair of conductor rails mounted to at least one of the guideways above the track, each of the conductor rails having an engaging surface that faces generally laterally away from the engaging surface of the other conductor rail;

a power supply connected to the conductor rails;

a follower assembly mounted to the vehicle in engagement with the conductor rails for steering the vehicle in response to the position of the conductor rails, the follower assembly having a pair of brushes that slidingly engage the engaging surfaces of the rails for receiving electrical power therefrom, the brushes being electrically connected to the vehicle controller for supplying power to the power unit; and a lifting device mounted to the follower assembly for raising the brushes into engagement with the conductor rails and lowering the brushes from engagement with the rails.

26. A transport system, comprising:

a pair of laterally spaced guideways, each of the guideways having an upward facing track;

a vehicle having lateral supports extending from opposite sides of the vehicle for cooperative engagement with the tracks, the vehicle having a power unit with a vehicle controller for causing the vehicle to traverse along the guideways;

a pair of conductor rails mounted to at least one of the guideways above the track, each of the conductor rails having an engaging surface that faces generally laterally away from the engaging surface of the other conductor rail;

a power supply connected to the conductor rails;

a follower assembly mounted to the vehicle in engagement with the conductor rails for steering the vehicle in response to the position of the conductor rails, the follower assembly having a pair of brushes that slidingly engage the engaging surfaces of the rails for receiving electrical power therefrom, the brushes being electrically connected to the vehicle controller for supplying power to the power unit;

a third conductor rail having a downward facing engaging surface that is electrically connected to the power supply; and a third brush that is mounted to the follower assembly for sliding contact with the third conductor rail for receiving electrical power therefrom.

27. A transport system, comprising:

a pair of laterally spaced guideways, each of the guideways having an upward facing track;

a vehicle having lateral supports extending from opposite sides of the vehicle for cooperative engagement with the tracks the vehicle having a power unit with a vehicle controller for causing the vehicle to traverse along the guideways;

a pair of conductor rails mount to at least one of the guideways above the track, each of the conductor rails having an engaging surface that faces generally laterally away the engaging surface of the other conductor rail;

a power supply connected to the conductor rails;

a follower assembly mounted to the vehicle in engagement with the conductor rails for steering the vehicle in response to the position of the conductor rails, the follower assembly having a pair of brushes that slidingly engage the engaging surfaces of the rails for receiving electrical power therefrom, the brushes being electrically connected to the vehicle controller for wherein the engaging surfaces of the rails also face downwardly at an acute angle relative to horizontal, and the follower comprises:

a pair of laterally spaced-apart arms that extend upwardly, and wherein the brushes are mounted to inside surfaces of the arms and face generally upward and toward the engaging surfaces of the rails.

28. A transport system, comprising:

a pair of laterally spaced guideways, each of the guideways having an upward facing track;

a vehicle having lateral supports extending from opposite sides of the vehicle and located above the tracks;

a pair of rails mounted to at least one of the guideways above the track, each of the rails having an engaging surface that faces generally downward and laterally away from the engaging surface of the other rail;

a follower assembly mounted to the vehicle and having a pair of steering members, each of the steering members having a face that faces generally upward and toward the face of the other steering member at the same inclinations as the engaging surfaces of the rails;

a lifting device for selectively lifting the steering members into cooperative engagement with the rails and lowering the steering members away from cooperative engagement with the rails; and a steering mechanism on the vehicle that steers the vehicle in response to the cooperative engagement of the steering members with the rails.

29. The system according to claim 28, wherein the follower assembly further comprises:

a pair of upward extending arms, each of the arms carrying one of the steering members; and a bias member mounted to each of the arms for biasing the steering members into cooperative engagement with the rails.

30. The system according to claim 28, wherein each of the steering members slidingly engages one of the rails.

31. The system according to claim 28, further comprising a sensor that monitors lateral forces exerted on the steering members and provides signals in response thereto; and the steering mechanism comprises:

a servo actuator that receives the signals and steers the vehicle accordingly.

32. The system according to claim 28, wherein each of the steering members comprises an air chamber having at least one hole; and the vehicle further comprises:

an air compressor for supplying air to the chamber for discharging air from the hole to space the chamber from one of the rails by a gap.

33. The system according to claim 28, wherein at least one of the rails comprises an electrical conductor adapted to be supplied with electrical power; and the follower assembly further comprises:

a brush mounted thereto for slidingly engaging the conductor for receiving electrical power.

34. The system according to claim 28, wherein at least one of the rails comprises an electrical conductor adapted to be supplied with electrical power; and at least one of the steering members comprises a brush in sliding engagement with the electrical conductor.

35. A transport system, comprising:

a pair of laterally spaced guideways, each of the guideways having an upward facing track;

a vehicle having lateral supports extending from opposite sides of the vehicle and located above the tracks;

a pair of rail engaging surfaces mounted to at least one of the guideways above the track, each engaging surfaces facing generally laterally away from the other engaging surface;

a follower assembly mounted to the vehicle and having a pair of air chambers, each of the air chambers having a face that faces generally toward the face of the other air chamber for juxtaposition with one of the engaging surfaces;

each of the air chambers having at least one hole;

an air compressor carried by the vehicle for supplying air to the air chambers for discharging air from the holes to space the air chambers from the engaging surfaces by gaps; and a steering linkage connected with the air chambers to steer the vehicle in accordance with lateral movement of the follower assembly as the air chambers move along the engaging surfaces.

36. The system according to claim 35, wherein the lateral supports of the vehicle comprise:

a plurality of air cushion members that support the vehicle above the tracks, the air cushion members having downward facing surfaces containing at least one hole for discharging pressurized air against the tracks to levitate the vehicle; at least one of the air cushions comprises:

a recess located in the face;

an electrical brush mounted in the recess and biased downward for sliding contact with one of the tracks; and said one of the tracks being electrically conductive for providing electrical power through the brush to the vehicle.

37. A method of steering a vehicle on a transport system having a pair of laterally spaced-apart guideways, each having an upward facing track surface; the method comprising:

(a) mounting a pair of rail surfaces to one of the guideways above the track surface, one of the rail surfaces facing laterally outward and the other facing laterally inward relative to the longitudinal axis, the rail surfaces extending longitudinally along the guideway;

(b) providing a vehicle with a plurality of lateral supports, and cooperatively engaging the lateral supports with the track surfaces;

(c) mounting a follower assembly to the vehicle, the follower assembly having a pair of follower members, one having a flat face that faces laterally outward and the other having a flat face that faces laterally inward; then (d) raising the follower assembly relative to the vehicle into cooperative engagement with the rail surfaces, causing the vehicle to move along the guideways, and steering the vehicle in accordance with lateral movement of the follower assembly as it moves along the rail surfaces.

38. The method according to claim 37, wherein step (d) comprises slidingly engaging the faces of the follower members with the rail surfaces.

39. The method according to claim 37, wherein step (d) comprises slidingly engaging the faces of the follower members with the rail surfaces, monitoring lateral forces imposed on the follower assembly by the rail surfaces, and providing signals to a servo actuator that steers the vehicle accordingly.

40. The method according to claim 37, wherein step (d) comprises creating a gap between the faces of the follower members and the rail surfaces with magnetic fields.

41. The method according to claim 37, wherein step (d) comprises creating a gap between the faces of the follower members and the rail surfaces by discharging pressurized air out of holes in the faces of the follower members.

42. The method according to claim 37, wherein:

step (b) comprises magnetically levitating the lateral supports above the track surfaces; and step (a) comprises inclining the rail surfaces and the flat faces of the follower members relative to horizontal; and the method further comprises stabilizing vertical movement of the vehicle as it moves along the guideway by the engagement of the follower members with the rail surfaces.

43. A method of supplying power and steering control to a vehicle on a transport system, having a pair of laterally spaced guideways that receive lateral supports of the vehicle, comprising:

(a) mounting at least one conductor rail mounted to one of the guideways and supplying electrical power to the conductor rail;

(b) mounting a follower assembly mounted to the vehicle placing the follower assembly in engagement with the conductor rail;

(c) delivering electrical power from the conductor rail to the follower assembly to cause the vehicle to move along the guideways; and (d) steering the vehicle in response to lateral movement of the follower assembly as the follower assembly moves along the rail.

44. A method of supplying power and steering control to a vehicle on a transport system, having a pair of laterally spaced guideways that receive lateral supports of the vehicle, comprising:

(a) mounting at least one conductor rail mounted to one of the guideways and supplying electrical power to the conductor rail;

(b) mounting a follower assembly mounted to the vehicle placing the follower assembly in engagement with the conductor rail;

(c) delivering electrical power from the conductor rail to the follower assembly to cause the vehicle to move along the guideway;

(d) steering the vehicle in response to lateral movement of the follower assembly as the follower assembly moves alone the rail; and wherein step (b) comprises moving the follower assembly upward from a retracted position.

45. A method of supplying power and steering control to a vehicle on a transport system, having a pair of laterally spaced guideways that receive lateral supports of the vehicle, comprising:

(a) mounting at least one conductor rail mounted to one of the guideways and supplying electrical power to the conductor rail;

(b) mounting a follower assembly mounted to the vehicle placing the follower assembly in engagement with the conductor rail;

(c) delivering electrical power from the conductor rail to the follower assembly to cause the vehicle to move along the guideways;

(d) steering the vehicle in response to lateral movement of the follower assembly as the follower assembly moves along the rail; and wherein step (d) comprises monitoring lateral forces imposed on the follower assembly by the conductor rail and providing signals to a servo actuator that steers the vehicle accordingly.

46. A method of supplying power and steering control to a vehicle on a transport system, having a pair of laterally spaced guideways that receive lateral supports of the vehicle, comprising:

(a) mounting at least one conductor rail mounted to one of the guideways and supplying electrical power to the conductor rail;

(b) mounting a follower assembly mounted to the vehicle placing the follower assembly in engagement with the conductor rail;

(c) delivering electrical power from the conductor rail to the follower assembly to cause the vehicle to move along the guideways;

(d) steering the vehicle in response to lateral movement of the follower assembly as the follower assembly moves along the rail; and wherein step (b) comprises: providing the follower assembly with an electrical brush that slidingly engages the rail for receiving electrical power in step (d) and mounting an air cushion chamber with at least one hole on one side to the follower assembly, supplying compressed air to the chamber which discharges out the hole into contact with the conductor rail, thereby creating a gap between the conductor rail and the chamber.

* * * * *